United States Patent [19]

Archer

[11] 4,233,769

[45] Nov. 18, 1980

[54] REAL ESTATE SIGN SUPPORT

[76] Inventor: Richard L. Archer, 14100 Chadron, Hawthorne, Calif. 90250

[21] Appl. No.: 966,083

[22] Filed: Dec. 4, 1978

[51] Int. Cl.[3] ..... G09F 7/20

[52] U.S. Cl. ..... 40/607; 40/155; 40/610; 248/530

[58] Field of Search ..... 40/606, 607, 610, 612, 40/155; 148/530, 532, 533, 534, 535, 539, 540

[56] References Cited

U.S. PATENT DOCUMENTS

| | | | |
|---|---|---|---|
| 786,481 | 4/1905 | Burdick | 40/606 |
| 905,471 | 12/1908 | Smith | 40/155 X |
| 1,649,249 | 11/1927 | Newman | 40/607 |
| 2,016,942 | 10/1935 | Horwitt et al. | 40/155 X |
| 2,559,302 | 7/1951 | Louft | 40/607 |
| 2,926,442 | 3/1960 | Reimel | 40/606 |
| 3,171,626 | 3/1965 | Keats | 40/607 |
| 3,608,220 | 9/1971 | Fryrear | 40/606 |
| 3,950,874 | 4/1976 | Diggs | 40/606 X |

*Primary Examiner*—John F. Pitrelli

*Attorney, Agent, or Firm*—William C. Babcock

[57] ABSTRACT

Disclosed herein is a sign support collapsible for transport and which is conveniently adjustable to accommodate signs of various dimensions. The sign support comprises an assembly of an L-shaped upright provided with a pointed spike at one end and with a cantelevered foot extension by which the uprights may be driven into ground. Formed in one surface of the L-shaped uprights are a plurality of elongate, longitudinally aligned and longitudinally spaced slots each dimensioned to receive an offset clasp extending from the back side of a U-shaped lower sign channel. An upper sign channel, similarly U-shaped in section, is provided with an L-shaped clamp on the back side thereof terminating at the free end in a split circular hoop which, at the juncture of the split, extends in an opposing tab for grasping one of the surfaces of the L-shaped upright. In this manner the upper channel can be conveniently mounted by rotating the L-shaped clamp onto one surface thereof, allowing for height adjustment and furthermore providing in the hoop opening a pocket for receipt of flag poles or other advertising structures.

1 Claim, 6 Drawing Figures

REAL ESTATE SIGN SUPPORT

BACKGROUND OF THE INVENTION

1. Field of the Invention

The present invention relates to sign supports, and more particularly for collapsible sign supports adapted for quick assembly.

2. Description of the Prior Art

The installation of signs at frequently varying locations is a practice extensively engaged in real estate. In today's volatile real estate market the convenience and speed with which a sign may be erected has significant bearing on the eventual sale. Quite often a home owner deliberates extensively on the decision to sell and in those deliberations susceptible to external facts, particularly to economic indicia which are also available to other home owners. Thus decisions to sell are normally a group phenomenon each home owner seeking the assistance of one particular agent in the course of the deliberation. Accordingly, the speed with which the selling effort is engaged in after the decision is quite significant since it both commits the seller to the selling venture and also presents at the earliest opportunity the home to the potential buyer. Furthermore, a successful real estate transaction often triggers additional decisions in the neighborhood with the result that the more expeditious agent also realizes a higher volume of listings.

One of the aspects of salesmanship is the deployment of various signs, particularly signs indicating an open house which in many communities can be deployed on a selected day basis. Once more the convenient deployment of the sign is of significance and it is this convenience that is achieved in the present invention.

SUMMARY OF THE INVENTION

Accordingly it is the general purpose and object of the present invention to provide a collapsible sign support which can be conveniently broken down for storage and transport.

Additional objects of the invention are to provide a sign support assembly which may be conveniently engaged to support signs of various dimensions.

Yet further objects of the invention are to provide a sign support assembly which requires no tools in the course of the erection thereof.

Briefly these and other objects are accomplished within the present invention by providing a substantially L-shaped upright terminating in a sharp point at one end thereof for insertion into ground and including in one of the L surfaces a plurality of elongate longitudinally aligned and longitudinally spaced slots. Each of the slots is conformed to receive an elongate, off-set clasp attached to the back surface of a U-shaped lower channel, allowing for the placement of the channel at various heights relative the spiked end of the upright. A similarly U-shaped upper channel is provided with a cantelevered clamp assembly, the clamp assembly comprising a vertical spine member terminating in a rolled over hoop at the free edge, the hoop being split to form an end tab dimensioned to grasp one leg of the L-shaped upright. Thus the upper channel may be conveniently installed onto the L-shaped upright by inserting the surface of the L into the split in the hoop and rotating the clamp assembly around the exterior apex of the L to effect grasping. Once the upright is so grasped, it is then possible to slide the upper channel downwardly onto the upper edge of the sign, thus retaining the sign. In addition to the above features, the split hoop provides for a convenient pocket into which various flags may be inserted to aid visibility. These features all combine to allow for convenient erection and collapse and particularly to allow these functions without the aid of any tools.

DESCRIPTION OF THE SPECIFIC EMBODIMENT

Figure 1:
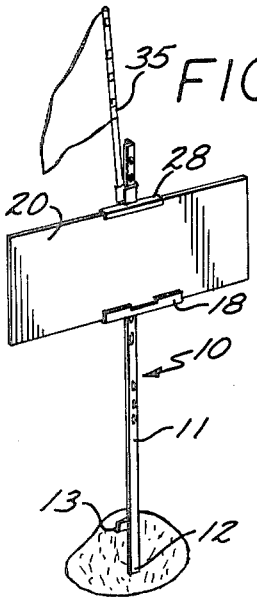
FIG. 1 is a perspective illustration of a sign support in its erected form constructed according to the present invention.
Figure 2:
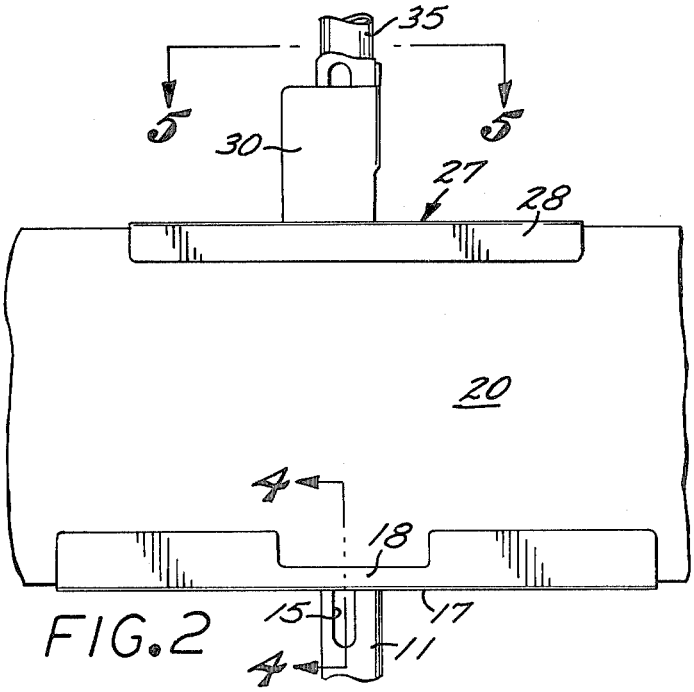
FIG. 2 is a front view of the inventive sign support illustrating the details of the engagement thereof.

As shown in FIGS. 1–5 the inventive sign support assembly, generally designated by the numeral 10, comprises an L-shaped upright 11 provided with a lower end 12 insertable into ground by way of a foot peg 13 cantelevered therefrom. Formed in one surface of the upright 11 are a plurality of longitudinally aligned and longitudinally spaced elongate slots 15 conformed to receive an offset clasp 16 extending and affixed to the back surface of a U-shaped lower channel 17.

Figure 4:
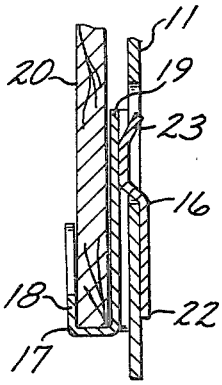
FIG. 4 is a sectional side view illustrating the clasping detail shown at line 4—4 of FIG. 2.
Figure 3:
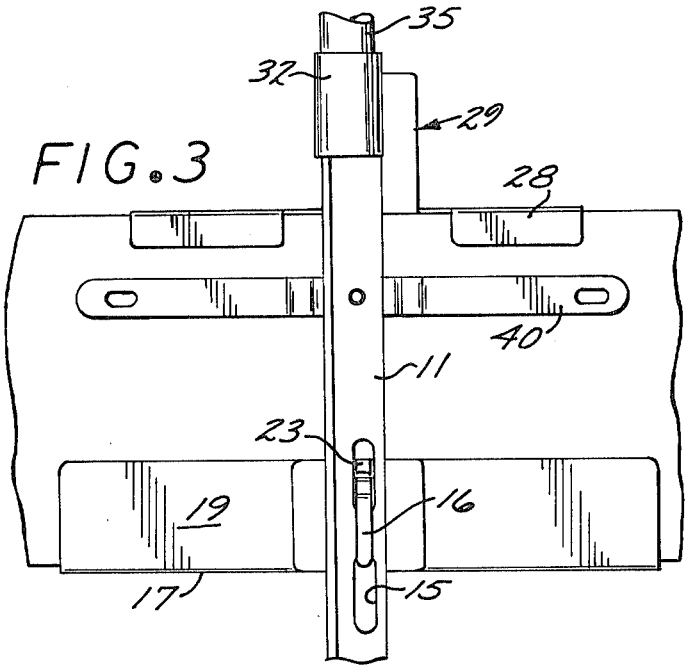
FIG. 3 is a back detail view of the sign support shown in FIG. 2.
Figure 5:
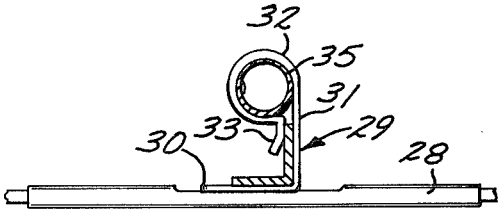
FIG. 5 is a top view in partial section illustrating a top view detail taken along line 5—5 of FIG. 2.

By more specific reference to FIG. 4 the lower channel 17 is adapted for an upwardly opened orientation thus providing a horizontal slot into which the lower edge of a sign 20 may be received. In order to minimize the obscuring of the sign by the channel surfaces of the lower support channel 17 the front surface 18 is formed to smaller dimensions and the dimensions of the back surface 19. It is this back surface 19 that attachment is made with clasp 16, the clasp being formed as an offset surface secured to the lower support channel on one side of the offset and extending downwardly in a free cantelevered tab 22 which is conformed for insertion into the aforementioned slot 15. Clasp 16, furthermore, includes at the attached end thereof, a bent-over projection 23 conformed to extend into the interior of slot 15 and thus oppose upward translation of the lower channel 17 to the confines of the slot. By selecting the length of tab 22 to a dimension greater than the length of slot 15 it is thus possible to limit the upward motion thereof and thus limit the convenience of removal of the lower channel 17. By this feature the lower support channel 17 is engaged to the upright 11 in a substantially child-proof engagement assuring the integrety of the support structure once erected. These features are achieved while at the same time allowing for withdrawal by the upward translation of the lower support channel followed by an outward turning of the upper edge thereof.

The sign 20, thus retained at the lower edge thereof by the attachment of the lower channel 17, may be secured at the upper edge by an upper support channel assembly 27, comprising a downwardly directed horizontal U-shaped channel section 28 which is attached at the back surface thereof to a clamp assembly 29. With particular reference to the illustrated matter set out in FIG. 5, clamp assembly 29 comprises an L-shaped sheet metal structure having a portion of the leg 30 secured to the back surface of the channel segment 28. In this form the other leg 31 of the L-shaped sheet metal structure extends as a dorsal spine away from the rear surface of the upper support assembly to terminate at the free edge thereof in a rolled-over hoop 32 which is bent to oppose surface 31 by a spring tab 33. Spring tab 33 may be turned-outwardly proximate the free edge thereof and is separated from surface 31 by a dimension smaller than the thickness of the surfaces of the upright 11. The alignment of hoop 32, furthermore, and the deployment of tab 33 are over the surface or the leg 30, the free edge of tab 33 being separated from the leg 30 by a dimension smaller than the width of the legs of the upright 11. Thus the clamp assembly 29 may be installed onto the upright 11 by inserting one surface thereof into the space between tab 33 and leg or surface 31, the exterior apex of the upright being then receivable into the space formed between the legs 31 and 30. In this position the upper support assembly 27 may be translated downwardly onto the sign 20, grasping the upper edge of the sign.

As a further feature, hoop 32 may include a tubular pocket 35 into which the lower end of an elongate member 40 that serves as a support for a flag 42 may be inserted.

While the rigidity of the foregoing assembly is substantially secure, further structural support against wind loads on the sign may be provided by way of a cross member strap 40 secured to the slotted surface of upright 11 and extending transversely thereacross. Strap 40 thus provides the additional support to the back sise of the sign 20 for opposing wind loads.

Figure 6:
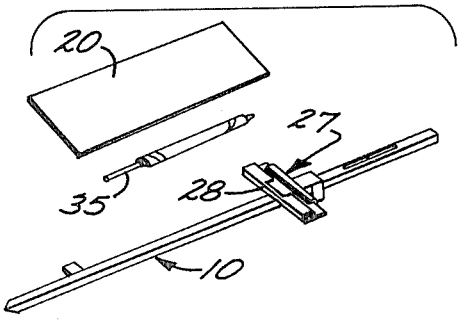
FIG. 6 is an illustration in aggregate of the collapsed elements comprising a sign support erectable according to the present invention.

The foregoing assembly may be collapsed for transport as illustrated in FIG. 6. More specifically, a convenient and compact package may be formed by sliding the upper support assembly downwardly onto the lower support channel 17, which may then be collected together with a sign 20 and any flags for transport.

Obviously many modifications and changes may be made to the foregoing description without departing from the spirit of the invention. It is therefore intended that the scope of the invention be determined solely on the claims appended hereto.

What is claimed is:

1. A realtor's sign assembly capable of being carried in a dismantled condition from location to location, and erected at a desired location without the use of tools, said sign assembly including:

a. a sign in the form of a stiff rectangular sheet having first and second sides, and a message for the public imprinted on said first side;

b. an elongate rigid upright of transverse L-shaped cross-section, defined by first and second normally disposed legs, said upright having a pointed end, a foot peg that projects outwardly from said upright adjacent said pointed end, and said foot peg when a downward force is applied thereto forcing the portion of said upright adjacent thereto downwardly into the ground, with said upright being removably supported in a vertical position from the ground as a result thereof, said first leg having a plurality of longitudinally spaced slots therein;

c. a first sign support assembly, said first assembly including a first rigid transverse member of channel shape transverse cross section of substantially the same length as said sign, said first member capable of removably supporting the lower longitudinal edge of said sign, and an elongate tab secured to said first member and spaced therefrom, said tab capable of being selectively and removably inserted in one of said slots to maintain said first assembly at a desired elevation on said upright;

d. a second sign support assembly, said second assembly including a second rigid transverse member of channel shaped cross-section that is capable of removably gripping the upper longitudinal edge of said sign, first means secured to said second, said first means frictionally gripping the upper portion of said upright, with said second assembly gripping the upper longitudinal edge of said sign when said first assembly engages the lower longitudinal edge of said sign, and said first and second assemblies cooperating to hold said sign at a desired elevation on said upright, and said first means including a downwardly extending pocket capable of receiving and removably supporting a lower end portion of an elongate rigid member that has a flag secured thereto, said first means includes a strip of resilient metal secured to said first member and defining a hoop, with said hoop at least partially defining said pocket, and portions of said hoop frictionally engaging said upright to maintain said second assembly at a desired elevation thereon.

* * * * *